United States Patent [19]

King et al.

[11] Patent Number: 4,556,024

[45] Date of Patent: Dec. 3, 1985

[54] ENGINE LUBRICATION SYSTEM

[75] Inventors: Edward T. King, Dearborn; Granger K. Chui, Dearborn Heights, both of Mich.

[73] Assignee: Ford Motor Company, Dearborn, Mich.

[21] Appl. No.: 689,365

[22] Filed: Jan. 7, 1985

[51] Int. Cl.[4] ..... F01M 1/00

[52] U.S. Cl. ..... 123/196 AB; 123/142.5 R; 184/104.2; 165/51

[58] Field of Search ..... 123/196 R, 196 S, 142.5 R, 123/196 AB; 165/52, 51, 35, 36; 184/104 A, 104 B

[56] References Cited

U.S. PATENT DOCUMENTS

| | | | |
|---|---|---|---|
| 1,269,310 | 6/1918 | Ringlund | 184/104 |
| 1,579,231 | 4/1926 | Miller | 184/104 |
| 1,902,970 | 3/1933 | Ramsaur et al. | 165/95 |
| 1,989,585 | 1/1935 | Bigelow | 123/196 AB |
| 2,564,231 | 8/1951 | Pitney | 184/103 |
| 2,588,788 | 3/1952 | Tibeau | 184/6.13 |
| 2,670,933 | 3/1954 | Bay | 165/27 |
| 2,946,328 | 7/1960 | Mettetal, Jr. | 123/196 S |
| 3,335,736 | 8/1967 | Liebel et al. . | |
| 3,465,847 | 9/1969 | Donath et al. | 184/104 |
| 3,712,420 | 1/1973 | Pelizzoni et al. | 184/6.4 |
| 3,752,222 | 8/1973 | Olbermann, Jr. | 165/51 |
| 3,876,037 | 4/1975 | Rath, Jr. | 184/6.4 |
| 4,245,593 | 1/1981 | Stein | 165/51 |
| 4,249,491 | 2/1981 | Stein | 165/51 |
| 4,324,213 | 4/1982 | Kasting et al. | 123/196 A |
| 4,329,952 | 5/1982 | Buraas | 123/142.5 R |

*Primary Examiner*—E. Rollins Cross

*Attorney, Agent, or Firm*—Peter D. McDermott; Roger L. May

[57] ABSTRACT

Apparatus is disclosed for lubrication of the operating components of an internal combustion engine with accelerated heating of the lubricant during engine warmup, comprising (i) a primary circuit for lubricant recirculation including a primary reservoir adapted to receive lubricant drainage from the engine and a primary conduit adapted to return lubricant to the engine, (ii) means for pumping lubricant through the primary conduit to the engine, (iii) means for preheating the lubricant with heat produced by the engine employing a heat exchanger along the primary conduit, and (iv) an auxiliary lubricant reservoir and a return conduit providing fluid communication for the flow of lubricant from the auxiliary reservoir to the primary reservoir. A valve in the return line is controlled to permit flow of lubricant to the primary reservoir in response to a drop in the primary reservoir lubricant level. Means are provided for selectively diverting lubricant from the primary circuit to the auxiliary reservoir following engine warmup when the temperature of the lubricant in the primary circuit reaches a preselected operating temperature.

16 Claims, 2 Drawing Figures

ENGINE LUBRICATION SYSTEM

INTRODUCTION

This invention relates generally to engine lubrication systems and, more particularly, to a lubrication system having an auxiliary reservoir in addition to a primary reservoir, together with heat exchanger means to more rapidly heat the lubricant prior to delivery to the engine from the primary reservoir upon engine startup.

BACKGROUND OF THE INVENTION

It is well known that internal combustion engines wear at a faster rate during low temperature operation, such as that experienced upon initial operation of a cold engine. Considering the internal combustion engine of a motor vehicle, for example, upon initial operation of a cold engine the lubricating oil has drained into the crankcase and is highly viscous due to its flow temperature. Thus, the engine is operated for a time without adequate lubrication. Accordingly, it would be advantageous to more rapidly heat the reservoir of engine lubricant upon cold engine start-up. In addition, means have long been sought to increase the engine lubricant storage capacity both to reduce lubricant addition frequency and to extend the period between lubricant changes. Increasing the volume of lubricant stored in an engine lubricant reservoir, however, would exacerbate the above noted problem of inadequate engine lubrication during cold engine operation since, increasing the volume of lubricant would result in slower heating thereof.

Certain engine lubrication systems have been suggested, in which an auxiliary lubricant reservoir was employed to increase the total volume of stored lubricant. Such systems, however, have used lubricant from the auxiliary reservoir only to maintain the lubricant level in the primary lubricant reservoir. Thus, due to natural degredation of lubricant quality during operation of the engine, the lubricant in use is of a quality inferior to that of the unused lubricant stored in the auxiliary reservoir. An engine lubrication system exemplary of those adapted merely to maintain the level of lubricant in a primary reservoir is disclosed in Rath, Jr., U.S. Pat. No. 3,876,037 wherein a control circuit operates to open a conduit from a reserve tank to a primary tank. There is no teaching of recirculation of oil to the reserve tank. The engine lubrication system shown in Pellizzoni et al U.S. Pat. No. 3,712,420 employs a primary reservoir and an auxiliary reservoir with means for maintaining the proper oil level in the primary reservoir. Although the system provides for recirculation of lubricant through the auxiliary reservoir, there is no means provided for accelerated heating of the lubricant. The teaching in Liebel et al U.S. Pat. No. 3,335,736 also includes a device for controlling the addition of oil to an engine from a reservoir tank. Additional known systems employing auxiliary tanks to maintain a proper lubricant level in a primary tank are shown, for example, in Mettetal, Jr. U.S. Pat. No. 2,946,328 and Pitney U.S. Pat. No. 2,564,231. Tibeau U.S. Pat. No. 2,588,778 discloses a tank within a tank arrangement for maintaining lubricant level.

Previous attempts to provide means for heating engine lubricant include Miller U.S. Pat. No. 1,579,231 and Ringlund U.S. Pat. No. 1,269,310, each of which teaches the use of engine exhaust gas to heat lubricating oil directly in the oil pan of a motor vehicle engine.

There is no suggestion of means for accelerated heating of a portion of the lubricant. Similarly, U.S. Pat. No. 1,989,585 suggests locating a heat exchanger within a motor vehicle crankcase, through which heat exchanger engine cooling liquid is circulated. The teaching of Ramsaur et al U.S. Pat. No. 1,902,970 is directed primarily to a particular design for a heat exchanger and suggests the use of two such heat exchangers, one for heating and one for cooling engine lubricant. Others have suggested lubrication systems comprising means for cooling the lubricant. Exemplary of such teachings are Donath U.S. Pat. No. 3,465,847 and Casting et al U.S. Pat. No. 4,324,213.

It is an object of the present invention to provide an engine lubrication system comprising an auxiliary lubricant reservoir wherein lubricant is recirculated between the primary lubricant reservoir and the auxilary reservoir. Notwithstanding the increased volume of recirculating lubricant, it is another object of the invention to provide preheating or accelerated heating of the lubricant delivered to the engine.

SUMMARY OF THE INVENTION

According to the present invention, an improved engine lubrication system or appratus is provided. The system operates to recirculate lubricant to an internal combustion engine and provides the advantages of increased lubricant capacity while also providing accelerated lubricant warmup upon engine startup. More specifically, the invention provides an improved engine lubrication system wherein increased lubricant capacity is provided by an auxiliary lubricant reservoir, the lubricant of which auxiliary reservoir is recirculated to the engine during normal engine operation, while also providing much accelerated heating of engine lubricant during initial engine warmup to reduce cold engine operation and the resultant engine wear. That is, according to the present invention, the total lubricant capacity can be increased and yet the time required for the lubricant delivered to the engine to increase to operating temperatures is not correspondingly increased but, rather, is decreased. The engine lubrication means of the present invention comprises a primary lubricant circuit comprising a primary lubricant reservoir adapted to receive lubricant drainage from the engine and a primary conduit adapted to communicate lubricant from the primary reservoir back to the engine, and means for pumping lubricant through the primary conduit from the primary reservoir to the engine. Means are provided in line with the primary conduit for heating the lubricant with heat produced by the engine. That is, in being pumped from the primary reservoir to the engine, the lubricant passes through a heat exchanger which also receives a flow of heated fluid from the engine, for example, a flow of engine exhaust gases or a recirculating flow of liquid coolant. An auxiliary lubricant reservoir is provided together with means for selectively communicating lubricant from such auxiliary reservoir to the primary reservoir. Such lubricant communication means is responsive to the level of lubricant in the primary reservoir and, thus, is adapted to deliver lubricant to the primary reservoir when the level of lubricant therein falls below a preselected level. Means also are provided for selectively diverting lubricant form the primary circuit to the auxiliary reservoir, being responsive to the temperature of the lubricant received by the engine from the primary reservoir.

When the lubricant received by the engine reaches a preselected operating temperature, a portion or all of the flow of lubricant from the primary reservoir is diverted to recirculate through the auxiliary reservoir.

Other features and additional advantages of the invention will be disclosed in the following description, taken in connection with the accompanying drawings.

DETAILED DESCRIPTION PREFERRED EMBODIMENTS

Figure 1:
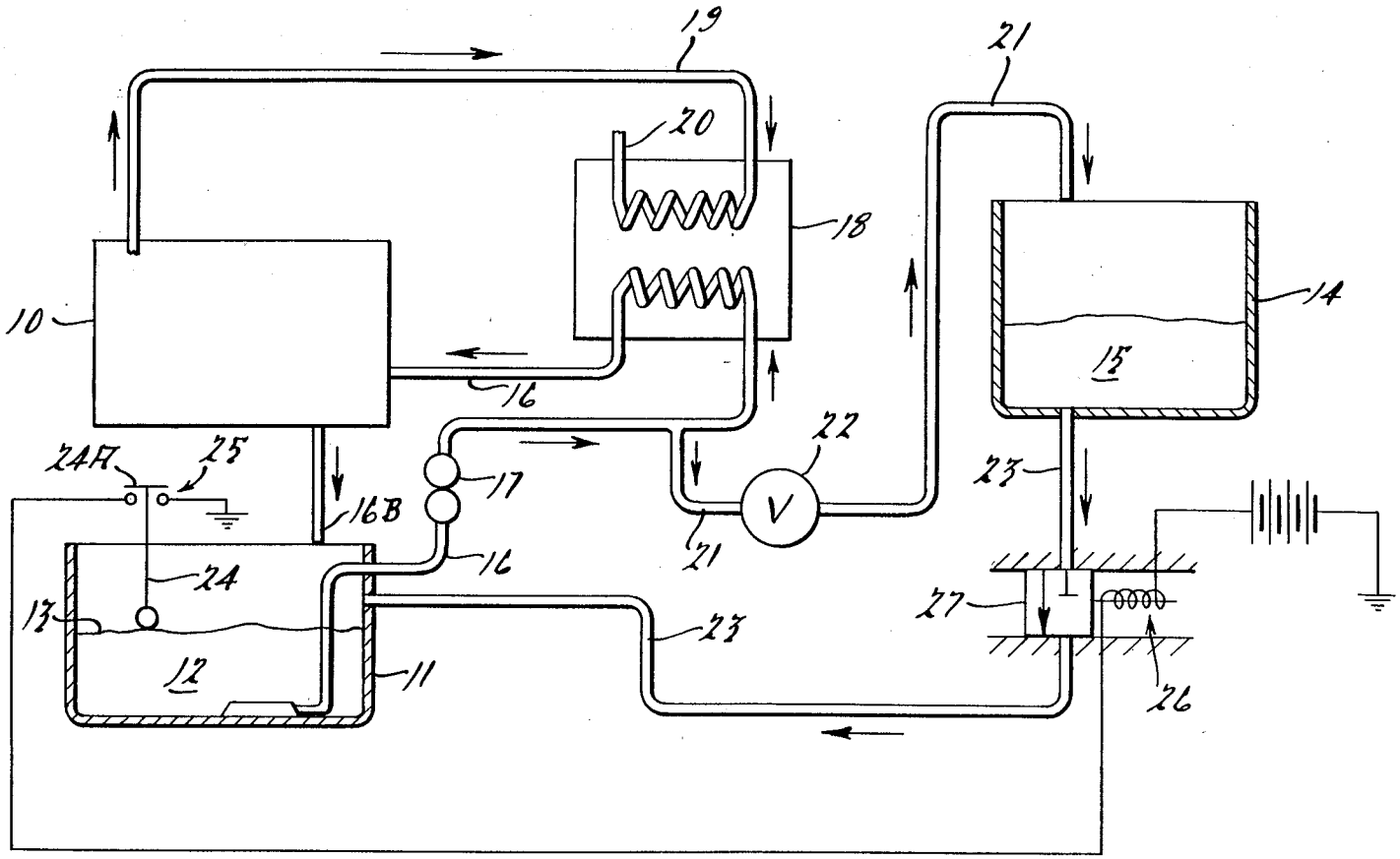
FIG. 1 is a schematic diagram showing the engine lubrication means according to one embodiment of the present invention, wherein direction of flow is indicated by arrows.

The present invention is especially suitable for use with the internal combustion engine of a motor vehicle and in the following discussion the engine to be lubricated will in certain instances be taken as such. Referring to FIG. 1, an engine 10 has a primary lubricant reservoir 11 adapted to receive lubricant drainage from the engine. Although shown diagrammatically to be detached, it will be understood that the primary reservoir 11 also can be integral with the engine. The reservoir 11 contains lubricant 12 to a desired or predetermined level 13. An auxiliary reservoir 14 contains additional lubricant 15 for supplementing the lubricant in the primary reservoir 11. A primary lubricant circuit includes the primary reservoir and a primary conduit 16 having one end submerged within the lubricant 12 within primary reservoir 11 and its other end in communication with the engine 10, that is, in fluid communication with the operating components thereof so as to deliver lubricant thereto. Lubricant drainage from the engine is shown diagrammatically to be communicated to the primary reservoir 11 via a portion of the primary circuit, conduit 16B, although it will be understood that such drainage may occur directly into the primary reservoir from a plurality of engine locations. Pump 17 is in line with conduit 16 and is adapted to pump lubricant through conduit 16 to the engine. Conduit 16 passes through heat exchanger 18 between pump 17 and engine 10. Conduit 19 carries a heated fluid from the engine to heat exchanger 18.

According to one embodiment of the invention, conduit 19 carries combustion exhaust gas from the exhaust manifold of engine 10 to heat exchanger 18. Exit conduit 20 can be adapted to purge an exhaust fumes to the atmosphere directly or through the exhaust system including, for example, a catalytic converter, muffler, etc. According to an alternative embodiment, wherein the engine 10 is adapted to be cooled by a liquid coolant, conduit 19 can be adapted to carry heated coolant from within the cylinder head water jackets of engine 10 to the heat exchanger. In this case, exit conduit 20 preferably would return the coolant fluid to the water jackets of engine 10. In this regard it is well known that water-cooled internal combustion engines typically comprise a radiator through which the coolant fluid is pumped to be cooled by atmospheric air. Normally, to speed engine warm-up, a thermostatically controlled valve is provided to prevent flow of coolant fluid to the radiator until the coolant fluid within the cylinder head water jackets reaches a preselected elevated temperature. Coolant fluid can be permitted to flow through conduits 19 and 20 either under normal back pressure existing within the cylinder head water jackets, or can be pumped through conduit 19 by auxiliary pumping means (not shown). According to one embodiment, conduit 19 can be in fluid communication with the outlet of the coolant fluid pump associated with the engine for recirculation of the coolant fluid through the engine's cooling system.

According to a preferred embodiment of the invention, wherein the engine is adapted to be cooled by a cooling system employing recirculating liquid coolant, and wherein the aforesaid heat exchanger 18 is adapted to receive a recirculating flow of such liquid coolant, a thermostatically controlled valve or like flow control means is provided to prevent flow of coolant fluid from the cylinder head water jackets to the heat exchanger until the coolant fluid has reached a preselected threshold lower temperature. Thereafter, such valve would open and conduit 19 would communicate heated coolant fluid to the heat exchanger to preheat the lubricant being supplied to the engine. This would allow more rapid initial heating of those operating components of the engine which are cooled by the coolant fluid. Thus, a water pump associated with the coolant fluid system would serve merely to circulate the coolant fluid within the cylinder head water jackets during such initial engine heating. It should be understood, therefore, that coolant fluid recirculated through heat exchanger 18 should be drawn from the cooling system upstream of the thermostat, e.g., from the cylinder head water jackets of the engine. It also should be understood that to ensure good mixing, the coolant fluid should be returned from heat exchanger 18 to a location within the water jackets sufficiently remote from the location at which conduit 19 draws off coolant fluid to the heat exchanger. According to this embodiment, therefore, conduit 20 in FIG. 1 would extend to be in fluid communication with the cylinder head water jackets of engine 10.

According to a highly significant aspect of the present invention, auxiliary conduit 21 is in fluid communication with primary conduit 16, passes through valve 22, and extends into fluid communication with auxiliary reservoir 14. Valve 22 is adapted to be open when the temperature of the lubricant in the primary circuit reaches a preselected lower limit. When valve 22 is open, lubricant will flow from the primary circuit to the auxiliary reservoir. Valve 22 can be, for example, a normally closed thermostatically controlled valve, such as presently are used in motor vehicle engine cooling systems, as mentioned above. Of course, such thermostatically controlled valve in the usual fashion would preferably permit a small amount of lubricant flow, especially if significantly remote from conduit 16, to ensure exposure of the thermostatic control mechanism to accurate lubricant temperatures. Alternatively, valve 22 can comprise a valve such as, for example, a ball valve, opened and closed by an electrically actuated solenoid or other suitable means. In this case, the solenoid could be adapted according to methods well known to those skilled in the art to be actuated in response to the temperature of the lubricant measured within conduit 16 or within the engine, primary reservoir or other convenient location. Most preferably the lubricant temperature is sensed in the primary reservoir or in primary conduit 16 proximate the primary reservoir. Thus, if the valve 22 is a self-contained thermostatically controlled valve of the type typically employed in motor vehicle liquid cooling systems, then preferably such valve is placed at the junction of primary conduit 16 and auxiliary conduit 21, or in the auxiliary conduit proximate such junction. Also, such junction preferably is at or near the point at which the primary conduit exits the auxiliary reservoir. Suitable signal generating temperature sensing means are well known and can be used in the present invention according to methods routine in the art.

The engine lubrication means of the invention provides means for feeding lubricant from the auxiliary reservoir 14 to the primary reservoir 11. Specifically, return conduit 23 is in fluid communication at one end with auxiliary reservoir 14 and at its other end with primary reservoir 11. Lubricant is cummunicated from the auxiliary reservoir to the primary reservoir through conduit 23, for example, by gravity feed or by suitable pumping means (not shown). According to an alternative embodiment, the auxiliary reservoir and primary reservoir are within a common housing and conduit 23 comprises a selectively openable gate. Flow of lubricant from the auxiliary reservoir to the primary reservoir is actuated by suitable means for sensing the lubricant level within the primary reservoir. Where conduit 23 comprises a gate between the auxiliary reservoir and the primary reservoir, such lubricant level sensing means can either directly open and close such gate or can generate a signal to actuate a solenoid or other responsive means to open and close such gate. In the embodiment illustrated in FIG. 1, the lubricant level sensing means comprises a float device 24 carrying switch closing means 24A. Lubricant is delivered to the primary reservoir through conduit 23 when the lubricant level within the primary reservoir falls sufficiently to close switch 25 which, in turn, actuates solenoid 26 to open normally closed valve 27. In view of the present disclosure, various suitable alternative sensing and actuation means for controlling flow of lubricant through conduit 23 will be readily apparent to those skilled in the art.

When engine 10 is started in a cold condition, pump means 17 begins immediately to pump lubricant from primary reservoir 11 through conduit 16. Lubricant returns from engine 10 to the primary reservoir through conduit 16B. In fact, as noted above, conduit 16B may comprise multiple return paths to the primary reservoir. Coolant fluid or exhaust gas from the engine would flow through conduits 19 and 20 to bring heat to heat exchanger 18. The lubricant within conduit 16 passing through heat exchanger 18 thus would be preheated, that is heated prior to delivery to the engine. During this initial period, only lubricant located within the primary reservoir is recirculated to the engine. Primary reservoir 11 need contain little more than sufficient lubricant for recirculation during this initial period and level sensor means 24 would be set to actuate flow of lubricant from the auxiliary reservoir only when the level of lubricant within the primary reservoir fell below the level occurring during this initial period. Accordingly, it will be understood that the lubricant within primary reservoir 11 is rapidly heated during the initial engine operation not only by passage through heat exchanger 18, but also during each passage through the engine, which it does more frequently due to the relatively small volume of lubricant contained by the primary reservoir. When the lubricant reaches a preselected elevated temperature, valve 22 opens and lubricant begins to flow through conduit 21 to the auxiliary reservoir. Since such diverted lubricant is not returned to the primary reservoir, the level of lubricant within the primary reservoir begins to fall. Lubricant sensing means 24 then actuates solenoid 26 to open valve 27 such that lubricant flows through conduit 23 to replenish the primary reservoir It can be seen that according to the present invention not only is the lubricant delivered to the engine heated more rapidly, but, in addition, this is achieved while simultaneously increasing the total lubricant capacity of the system. Moreover, the entire volume of lubricant within the system is employed to lubricate the engine during normal operating conditions. Lubricant is not retained in an auxiliary reservoir unused until added to the primary reservoir to maintain the level thereof. Rather, under normal operating conditions (i.e., when the temperature of the lubricant has risen sufficiently to open valve 22) the entire volume of lubricant within the system is being constantly recirculated to the engine.

Figure 2:
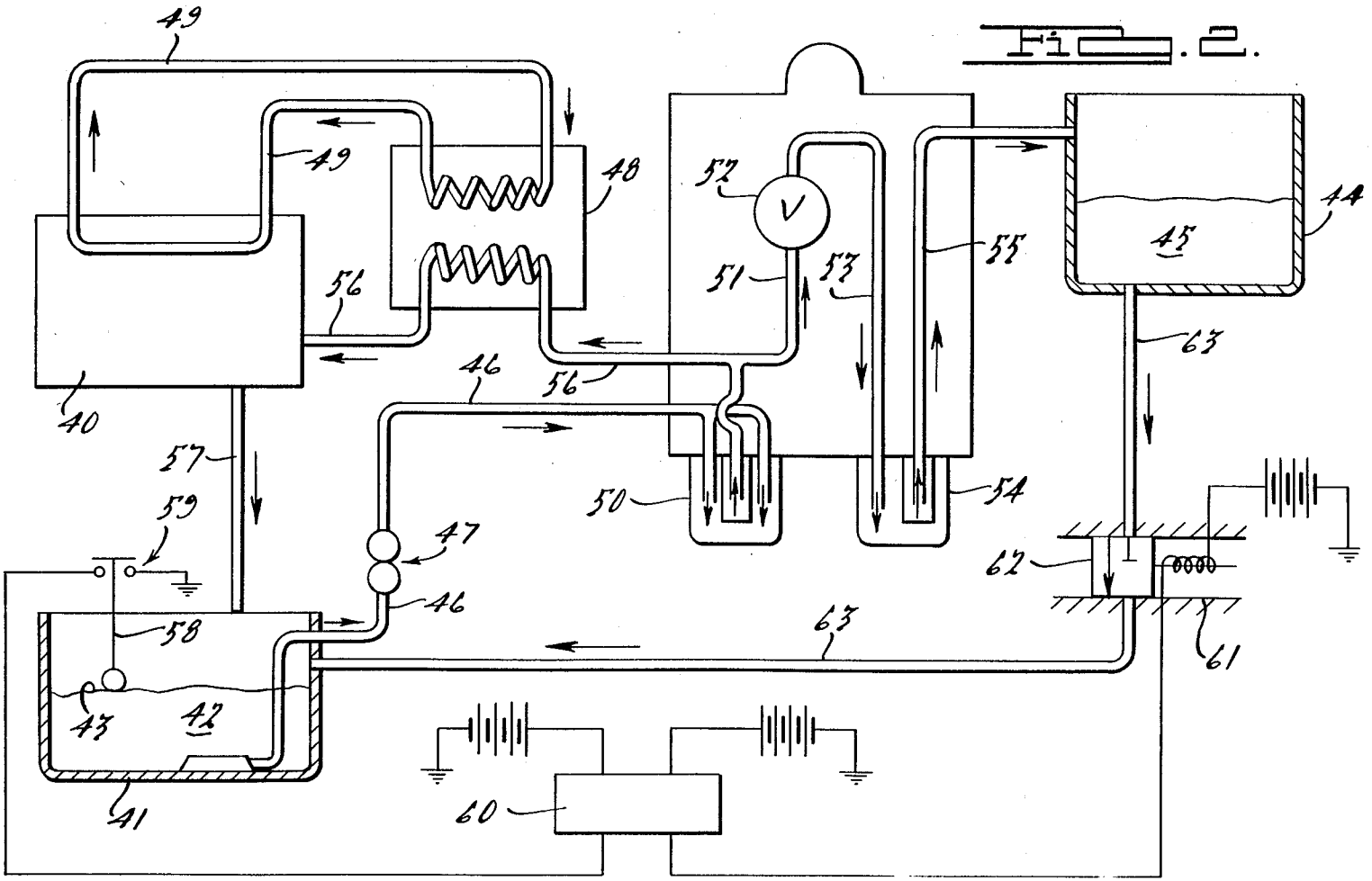
FIG. 2 is a schematic diagram of an engine lubrication means according to a preferred embodiment of the invention, wherein direction of flow is indicated by arrows.

Referring now to FIG. 2, a preferred embodiment of the invention is illustrated, wherein water cooled internal combustion engine 40 has an oil pan or primary reservoir 41. The primary reservoir 41 contains lubricant 42 to a predetermined level 43. An auxiliary reservoir 44 contains additional lubricant 45 for supplementing the lubricant in the primary reservoir 41. A primary conduit 46 has one end immersed in the lubricant 42 within the primary reservoir. Lubricant is pumped through conduit 46 by pump means 47 in line with conduit 46. Conduit 46 delivers the lubricant to standard, full-flow type oil filter 50. Conduit 56 is adapted to communicate lubricant from filter 50 to heat exchanger 48 where the temperature of the lubricant is increased by exposure to heat from engine coolant fluid recirculating through conduit 49. Conduit 51 is adapted to communicate lubricant from fiter 50 to normally closed thermostatically controlled valve 52. When the temperature of the lubricant in the primary circuit reaches a preselected minimum value, valve 52 is opened and conduit 53 carries lubricant to bypass filter 54. In a typical motor vehicle application, bypass filter 54 would provide filter medium finer than that of the standard filter 50. Conduit 55 carries lubricant from the bypass filter to auxiliary reservoir 44. Conduit 56, after passing through to heat exchanger, carries lubricant to the operating components of engine 40 to lubricate same. The lubricant is returned from the engine to the primary reservoir via conduit 57. Lubricant level sensing means 58 is adapted to close switch 59 in response to a drop in the lubricant level within the primary reservoir. This actuates normally open relay switch 60 which, in turn, actuates solenoid 61 to open normally closed valve 62. Conduit 63 carries lubricant from the auxiliary reservoir through valve 62 to the primary reservoir.

Upon starting engine 40 in a cold condition, lubricant is pumped from the primary reservoir through conduit 46 by means of pump 47. The lubricant flows through filter 50 to heat exchanger 48 and thence to the engine. Simultaneously or, optionally, following a short thermostatically controlled delay, engine cooling fluid flows through conduit 49 to the heat exchanger and then recirculates to the engine. Thus, lubricant from the primary reservoir is preheated prior to delivery to the engine. The lubricant level within the primary reservoir drops as lubricant is pumped to the engine but, preferably, the level does not fall sufficiently to cause level sensing means 58 to close switch 59. Thus, lubricant having been preheated in heat exchanger 48 and additionally heated during its passage through engine 40 is returned via conduit 57 to be recycled again to the engine. When the lubricant reaches a preselected temperature, thermostat 52 opens and lubricant flows through conduit 53 to the bypass filter 54 and thence via conduit 55 to the auxiliary reservoir. This diversion of lubricant ultimately causes the lubricant level within the primary reservoir to fall, causing sensing means 58 to close switch 59. This, in turn, acutates solenoid 61 through normally open relay switch 60. Actuation of solenoid 61 opens valve 62 causing lubricant from the auxiliary reservoir to flow via conduit 63 to the primary reservoir. Thus, when the lubricant reaches operating temperatures the entire volume of lubricant within the primary and auxiliary reservoirs are in circulation to the engine. Additionally, during such normal operating conditions, the lubricant quality is enhanced by means of the bypass filter without causing any restriction of the flow of lubricant to the engine.

In those embodiments of the present invention wherein the heat exchanger is adapted to receive coolant fluid from the engine, an additional advantage is provided by the invention. Specifically, the heat exchanger serves to cool the oil during high load operation or under such other circumstances as might cause the lubricant to overheat. That is, under such conditions the cooling fluid serves to cool rather than heat the lubricant by means of heat exchanger 48. In this regard, it will be recognized that in those embodiments of the invention employing exhaust gases from the engine to heat the lubricant in the heat exchanger, suitable means such as a valve actuated by lubricant temperature responsive means preferably are provided to stop the flow of exhaust gases to the heat exchanger once the lubricant reaches normal operating temperatures.

Since oil consumed by the engine is replenished from the auxiliary reservoir and the level of lubricant in the primary reservoir is maintained, there is no need to add oil until the reservoir is empty or near empty. The capacity of the reservoir is limited only by packaging constraints within the engine compartment or other location at which the auxiliary reservoir is to be located. Thus, in a motor vehicle consuming typically about one quart of lubricating oil per 3,000 miles traveled, a ten quart auxiliary reservoir would eliminate the need for oil addition for a distance of up to 30,000 miles. Increasing the total oil capacity also slows the depletion of certain additives typically used in lubricating oils and, hence, allows the extension of the interval between oil changes.

In view of the foregoing disclosure, it will be apparent to those skilled in the art that the present engine lubrication system is applicable to any internal combustion engine. It can be seen that this lubrication system maintains a desired lubricant level in the primary engine lubricant reservoir and, at the same time, both increases the total lubricant capacity to allow longer intervals between lubricant changes and provides faster lubricant warmup during initial engine operation. The engine lubricant supplied to the operating components of the engine is cleaner because of the larger amount of oil being circulated and because of the dual filtering provided according to preferred embodiment of the invention.

While the fundamental novel features of the invention have been shown and described, it will be understood from the disclosure that various substitutions, modifications and variations may be made by those skilled in the art without departing from the spirit and scope of the invention. Accordingly, all such modifications and variations are included within the intended scope of the invention as defined by the following claims.

We claim:

1. An engine lubrication means for recirculating lubricant to an internal combustion engine adapted to be cooled by a cooling fluid, providing both enhanced lubricant capacity and accelerated lubricant heating upon engine startup, said means comprising:

(A) a primary lubricant circuit comprising a primary lubricant reservoir adapted to receive lubricant drainage from said engine and a primary conduit adapted to communicate lubricant from said primary lubricant reservoir to said engine;

(B) means for pumping lubricant through said primary conduit from said primary lubricant reservoir to said engine;

(C) means for sensing the lubricant level within said primary lubricant reservoir;

(D) means for heating said lubricant with heat produced by said engine, comprising a heat exchanger in line with said primary conduit between said primary lubricant reservoir and said engine, said heat exchanger being adapted to receive a flow of heated fluid from said engine;

(E) an auxiliary lubricant reservoir;

(F) means for communicating lubricant from said auxiliary lubricant reservoir to said primary lubricant reservoir when the lubricant level within said primary lubricant reservoir is below a preselected level, said communicating means being adapted to be actuated by said means for sensing the lubricant level within said primary lubricant reservoir when the lubricant level with said primary lubricant reservoir is below a preselected level; and (G) means for selectively diverting lubricant from said primary circuit to said auxiliary reservoir, said diverting means being adapted to divert lubricant to said auxiliary reservoir when the temperature of lubricant within said primary circuit exceeds a preselected level.

2. The engine lubrication means of claim 1, wherein said engine is adapted to be cooled by a cooling fluid comprising liquid coolant which is recirculated in a cooling system comprising cylinder head water jackets, a radiator adapted to cool said liquid coolant, and a water pump adapted to recirculate said liquid coolant in said cooling system, said heat exchanger being adapted to receive a recirculating flow of said liquid coolant from said engine.

3. The engine lubrication means of claim 1, wherein said heated fluid comprises combustion exhaust gases from said engine.

4. The engine lubrication means of claim 1, wherein said heat exchanger is positioned in said primary conduit between said primary reservoir and said diverting means.

5. The engine lubrication means of claim 1, wherein said heat exchanger is positioned in said primary conduit between said diverting means and said engine.

6. The engine lubrication means of claim 1, wherein said diverting means comprises an auxiliary conduit adapted to communicate lubricant from said primary circuit to said auxiliary lubricant reservoir, a valve adapted when open to permit flow of lubricant from said primary circuit to said auxiliary conduit, and valve operating means for opening and closing said valve comprising means for sensing the temperature of said lubricant in said primary circuit, said valve operating means being adapted to close said valve when said lubricant temperature is below a preselected value and to open said valve when said lubricant temperature is above a preselected value.

7. The engine lubrication means of claim 1, wherein said diverting means comprises an auxiliary conduit adapted to communicate lubricant from said primary circuit to said auxiliary lubricant reservoir, and a thermostatically controlled valve adapted when open to permit flow of lubricant from said primary circuit to said auxiliary circuit, said thermostatically controlled valve being adapted to be closed when the temperature of said lubricant is below a preselected value and to be open when the temperature of said lubricant is above a preselected value.

8. The engine lubrication means of claim 1, wherein said auxiliary lubricant reservoir is separated from said primary lubricant reservoir by a common wall between them and said means for selectively communicating lubricant comprises a gate in said common wall and gate operating means for opening and closing said gate, said means for sensing lubricant level within said primary reservoir being adapted to open said gate when the lubricant level within said primary reservoir is below a preselected level and to close said gate when the lubricant level is above a preselected level.

9. The engine lubrication means of claim 1, wherein said means for selectively communicating lubricant comprises a return conduit adapted to communicate lubricant from said auxiliary lubricant reservoir to said primary lubricant reservoir, a normally closed valve in said return conduit, and return conduit valve operating means for opening and closing said return conduit valve, said return conduit valve operating means being adapted to open said return conduit valve when the lubricant within said primary lubricant reservoir is below a preselected level and to close said return conduit valve when said lubricant level is above a preselected level.

10. The engine lubrication means of claim 9, wherein said means for sensing the lubricant level within said primary lubricant reservoir is adapted to close a switch when said lubricant is below said preselected level to close a primary electrical circuit to actuate a relay switch to close a secondary electrical circuit to actuate said valve operating means to open said return conduit valve.

11. The engine lubrication means of claim 10, wherein said valve operating means comprises a solenoid.

12. The engine lubrication means of claim 1, further comprising means for filtering said lubricant.

13. The engine lubrication means of claim 12, wherein said lubricant filtering means is located in line with said primary conduit between said primary reservoir and said heat exchanger.

14. The engine lubrication means of claim 13, wherein said diverting means communicate line with said primary conduit between said filtering means and said heat exchanger.

15. The engine lubrication means of claim 12, wherein said diverting means comprising an auxiliary conduit adapted to communicate lubricant from said primary circuit to said auxiliary lubricant reservoir, said engine lubrication means further comprising secondary means for filtering said lubricant, said secondary filtering means being located in said auxiliary conduit between said primary circuit and said auxiliary reservoir.

16. An engine lubrication means for recirculating lubricant to an internal combustion engine adapted to be cooled by liquid coolant recirculated in a cooling system comprising cylinder head water jackets, a radiator adapted to cool said liquid coolant, and a water pump adapted to recirculate said liquid coolant in said cooling system, said engine lubrication means comprising, (A) a primary lubricant circuit comprising a primary lubricant reservoir adapted to receive lubricant drainage from said engine and a primary conduit adapted to communicate lubricant from said primary lubricant reservoir to said engine;

(B) means for pumping lubricant through said primary conduit from said primary lubricant reservoir to said engine;

(C) means for sensing the lubricant level within said primary lubricant reservoir;

(D) means for heating said lubricant with heat produced by said engine, comprising a heat exchanger in line with said primary conduit between said pumping means and said engine, said heat exchanger being adapted to receive a recirculating flow of liquid coolant from said engine to raise the temperature of said lubricant as it passes through said heat exchanger when said lubricant is at a lower temperature than said coolant liquid;

(E) a primary lubricant filter in said primary conduit between said pumping means and said heat exchanger;

(F) an auxiliary lubricant reservoir and a return conduit adapted to communicate lubricant by gravity feed from said auxiliary lubricant reservoir to said primary lubricant reservoir;

(G) a normally closed return valve in said return conduit between said auxiliary lubricant reservoir and said primary lubricant reservoir, and return valve operating means comprising a solenoid for opening and closing said return valve, said means for sensing the lubricant level within said primary lubricant reservoir being adapted when said lubricant level is below a preselected level to close a switch to close a primary electrical circuit adapted when closed to acutate a relay switch adapted when actuated to close a secondary electrical circuit adapted when closed to actuate said solenoid to open said return valve;

(H) an auxiliary conduit adapted to communicate lubricant from said primary conduit at a location between said primary filter and said heat exchanger to said auxiliary lubricant reservoir;

(I) a secondary lubricant filter in said auxiliary conduit between said primary conduit and said auxiliary lubricant reservoir; and (J) means for selectively diverting lubricant from said primary conduit to said auxiliary conduit, said diverting means comprising a thermostatically controlled valve adapted when open to permit flow of lubricant from said primary conduit to said auxiliary conduit, said thermostatically controlled valve being adapted to be closed when the temperature of said lubricant in said primary circuit is below a preselected value and to be open when the temperature is above a preselected value.

* * * * *